US007799996B2

(12) United States Patent
Tamm et al.

(10) Patent No.: US 7,799,996 B2
(45) Date of Patent: Sep. 21, 2010

(54) CORROSION RESISTANT AUTOMATIC SPLICE

(75) Inventors: R. Carl Tamm, Trussville, AL (US); Robert G. Hay, Pelham, AL (US); Stanley R. Siegrist, Leeds, AL (US)

(73) Assignee: Hubbell Incorporated, Shelton, CT (US)

( * ) Notice: Subject to any disclaimer, the term of this patent is extended or adjusted under 35 U.S.C. 154(b) by 231 days.

(21) Appl. No.: 12/155,249

(22) Filed: May 30, 2008

(65) Prior Publication Data

US 2009/0298358 A1 Dec. 3, 2009

(51) Int. Cl.
*H01R 4/00* (2006.01)

(52) U.S. Cl. ..... 174/88 R

(58) Field of Classification Search ..... 174/84 C, 174/88 R; 439/863

See application file for complete search history.

(56) References Cited

U.S. PATENT DOCUMENTS 2,572,940 A * 10/1951 Lockhart ..... 116/203
3,205,300 A 9/1965 Becker
3,859,455 A 1/1975 Gommans et al.
4,084,067 A 4/1978 Gillemot
4,486,620 A 12/1984 Ball et al.
4,673,233 A 6/1987 Hertelendy
4,698,031 A * 10/1987 Dawson ..... 439/863
4,810,829 A 3/1989 Rutenbeck et al.
4,985,598 A 1/1991 Bubica et al.
5,247,135 A 9/1993 Rebers et al.
5,278,353 A 1/1994 Buchholz et al.
5,322,973 A 6/1994 Dagan
6,359,228 B1 3/2002 Strause et al.
6,796,854 B2 9/2004 Mello et al.

* cited by examiner

*Primary Examiner*—Chau N Nguyen
(74) *Attorney, Agent, or Firm*—Jenae C. Gureff; Mark S. Bicks; Alfred N. Goodman

(57) ABSTRACT

A corrosion resistant automatic splice having a housing with opposed first and second ends, an interior cavity between the ends, and a plurality of drainage openings disposed between an exterior surface of the housing and the interior cavity. The first and second ends are each adjacent a biasing member or spring. A semi frustoconical gripping jaw or clamp is located at each of the first and second ends adapted for receiving a cable. The drainage openings aid in voiding corrosive contaminants from the interior cavity of the splice.

18 Claims, 4 Drawing Sheets

CORROSION RESISTANT AUTOMATIC SPLICE

FIELD OF THE INVENTION

The present invention relates to a corrosion resistant automatic splice having a housing with opposed first and second ends, an interior cavity therebetween, and a plurality of drainage openings disposed and extending between an exterior surface of the housing and the interior cavity. A first biasing member is adjacent to the first end and a second biasing member is adjacent to the second end. A tapered gripping jaw is located at each of the first and second ends adapted for receiving a cable.

BACKGROUND OF THE INVENTION

Splicing connectors for cables and electrical connectors, commonly referred to as automatic splices, have long been known, and are used by utility linemen to quickly splice lengths of suspended cable together.

The automatic splice has become a mainstay in the electrical utility industry. Originally developed for "emergency restoration", it has evolved into a nominal construction component for overhead power lines, and has been extensively used in the industry for approximately 70 years. With the major evolution to the use of aluminum conductors several decades ago, automatic splices were developed for aluminum conductors.

Aluminum, while more economical for construction, suffers more problems associated with corrosion and degradation of the electrical interface over time, in comparison to copper. Over the decades, due principally to economics and market competition, connectors, along with most products, have been "optimized" to be produced with the minimal amount of material required, the least amount of labor and finish, and designed to minimal performance standards to remain economically viable in the market. Such has been the case with automatic splices.

In particular, in corrosive environments, such as coastal areas, aluminum connectors of all types experience a reduction in service life. This reduction has been particularly prevalent with aluminum automatic splices. Along with the aging infrastructure, an abundance of catastrophic failures of aluminum automatic splices in such environments has led a number of electrical utilities which operate and maintain overhead electrical lines in these areas to remove aluminum automatic splices from their approved standards, thus prohibiting their installation in the corrosive environments.

Furthermore, in recognition of the many aluminum automatic splices installed heretofore, with their eminent premature failure approaching, some utilities have initiated in-service replacement programs. The most common conductor splice, heretofore favored as being the most robust in corrosive environments, is the standard compression splice. However, the labor and time, and thus the cost of making live line splices with compression tools is unreasonably prohibitive. Such programs often include cost estimates exceeding twenty times that of installation of automatic splices.

The market has recognized that the view of economics based on purchasing less robust splices with shorter life spans has been a poor choice for the long term. Utilities, which have come to realize this situation, have requested that a more robust automatic splice be developed which will withstand numerous fault currents over time, and resist the corrosion elements of coastal environments. Therefore, an analysis of the principal design shortcomings resulting from economic suppression was conducted, as well as analysis of failure modes and solutions.

The traditional design of automatic splices has been refined by economics, and has resulted in a splice tube body of minimal cross section, sufficient only to withstand the tensile load which could be applied by the conductor for which the splice is designed, along with a marginal safety factor. Thus, the addition of openings in the body of conventional splice designs would violate the required tensile strength.

Due to economics, the springs used in traditional automatic splices, used for the purpose of biasing the jaws into engagement with the conductor, have been made from steel plates. The plating on such springs does not last long, and consequently, rust begins to form, adding to the corrosive contaminants inside the splice body.

Analysis of the failure mode of aluminum automatics reveals the potential for corrosive elements to build up within the architecture of the device. In application, a catenary is formed when a conductor is suspended under tension between adjacent structures. The automatic splice serves to join two conductors at a location within this span. Therefore, there always exists a portion of conductor located above the position of the splice. As the prominent conductor is constructed with a plurality of strands, wound in a helical manner, it is impractical to attempt to seal the entry port of the connector about the periphery of the conductor, as the interstitial area between the strands will remain as a conduit for moisture to enter the splice body.

Pollutants and particulate matter settle on the conductor during dry periods, along with salt buildup in saline environments typical of those in coastal areas. In addition, during particularly foggy conditions, the salt fog enters into the body of the automatic splice, due to its open architecture. Rain and other precipitation will carry the aforesaid pollutants and particulate matter into the splice from the portion of exposed conductor which is above the position of the splice. Subsequently, following the precipitation event, temperature rise within the automatic splice occurs due to electrical current and solar gain, resulting in evaporation of the water, leaving the corrosive components inside the splice. The warm environment inside the splice contributes to the corrosive action.

In response to this recognition, certain devices have been designed to better withstand the rigors of the environment into which these splices are placed. U.S. Pat. No. 6,796,854 to Mello et al. represents a variation of U.S. Pat. No. 6,773,311 to Mello et al. providing an open architecture body such that contaminants do not build up within.

Accordingly, a need exists for an easy to use corrosion resistant splice that is resistant to line disturbances caused by wind and ice. Also, a need exists for a splice having features to promote the expulsion of corrosive components from the interior of the splice.

SUMMARY OF THE INVENTION

Accordingly, an object of the invention is to provide an improved automatic splice for connecting two electrical cables or conductors while eliminating corrosive material buildup within the splice.

Another object of the invention is to provide a cable-splicing device having opposed tapered ends surrounding a set of tapered gripping jaws adjacent each end.

A further object of the invention is to provide an automatic splice with a centrally located partition and a pair of springs, one on each side of the partition, to bias the jaws towards their respective ends.

Yet another object of the invention is to provide a splice having a plurality of openings disposed in polar array about the major diameter of the splice for draining liquid from the splice, eliminating corrosive elements and rinsing the splice.

Still another object of the invention is to provide a cable clamp in the form of an automatic splice, having features and provisions to better withstand exposure to corrosive atmospheres, elements, or environments, thus to extend the reasonable service life thereof.

A further object of the invention is to provide a cable clamp in which all of the components are compatible from a galvanic perspective to prevent corrosion due to galvanic potential differences within the splice or with the conductor for which it is designed and intended.

The foregoing objects are basically attained by providing a clamp for a cable, in the fashion of an automatic splice, having a housing a first end, a second end, and an interior cavity to receive the opposed ends of a cable or electrical conductor. At least two jaws are disposed within the cavity, preferably two sets of jaws located adjacent each opposed end. A biasing member disposed within the cavity biases the jaws towards the first end, and preferably a pair of biasing members, separated by a stopper, located in the approximate center of the body, the stopper supporting the biasing members and providing a positive location for the end of the cable or conductor when installed, and preventing the intrusion of the first cable installed into the cavity to receive the second end or opposed cable, thus assuring that each respective cable end will have sufficient area to be fully installed, its extreme end passing through to the full extent of the gripping jaws, such that complete purchase of the cable or conductor is afforded the clamp.

The method for splicing cables in a corrosion resistant splice is attained by providing a housing with two tapered ends and an interior cavity having a plurality of drainage openings oriented in polar array about a major diameter of the housing and extending between an exterior surface of the housing and the interior cavity. The two ends are separated by a stopper disposed towards the middle of the housing and coupled to first and second springs. A clamp attached at each of the ends for receiving a cable by inserting a cable into a funnel guide adjacent the ends and transporting the cable from the funnel guide into the clamp and towards the stopper in an adjacent retractable pilot cup.

A further method of splicing cables includes the steps of feeding an end of a first cable through the first end of a housing and into an interior cavity of the housing and feeding an end of a second cable through an opposite second end of the housing into the interior cavity. The housing tapers towards the first and second ends thereof. The method further involves gripping the first and second cables by first and second pairs of frustoconical clamping jaws on the interior cavity adjacent the first and second ends thereof and passing environmental moisture through a plurality of drainage openings into and out of the housing between the pair of clamping jaws to clean out corrosive agents.

As used in this application, the terms "top", "bottom", and "side" are intended to facilitate the description of the corrosion resistant automatic splice, and are not intended to limit the description of the corrosion resistant automatic splice to any particular orientation.

Other objects, advantages, and salient features of the present invention will become apparent from the following detailed description, which, taken in conjunction with the annexed drawings, discloses a preferred embodiment of the invention.

BRIEF DESCRIPTION OF THE DRAWINGS

Referring to the drawings which form a part of this disclosure.

Throughout the drawings, like reference numerals will be understood to refer to like parts, components, and structures.

DETAILED DESCRIPTION OF THE INVENTION

Figure 1:
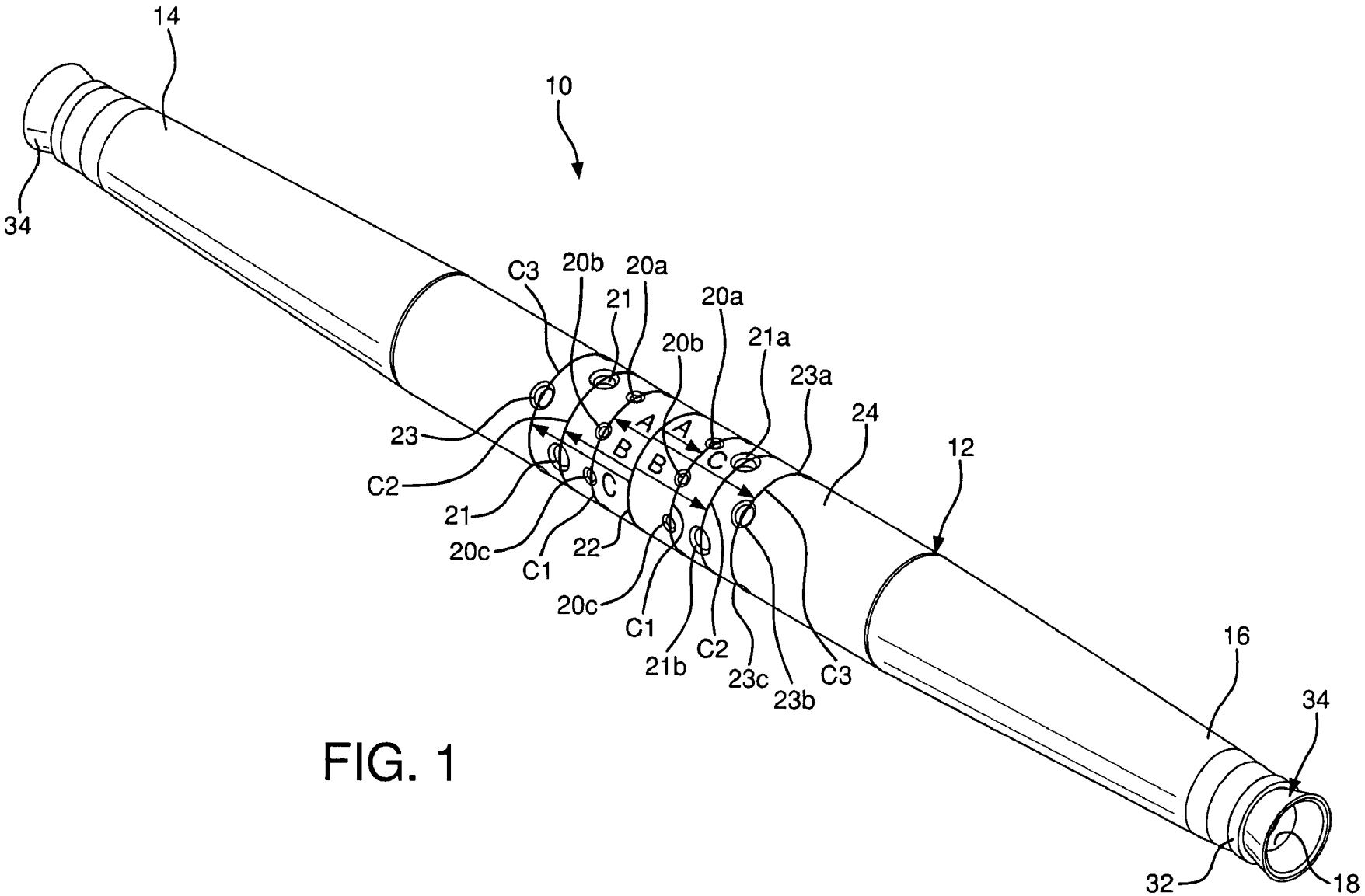
FIG. 1 is a front perspective view of the splice according to an embodiment of the present invention.
Figure 2:
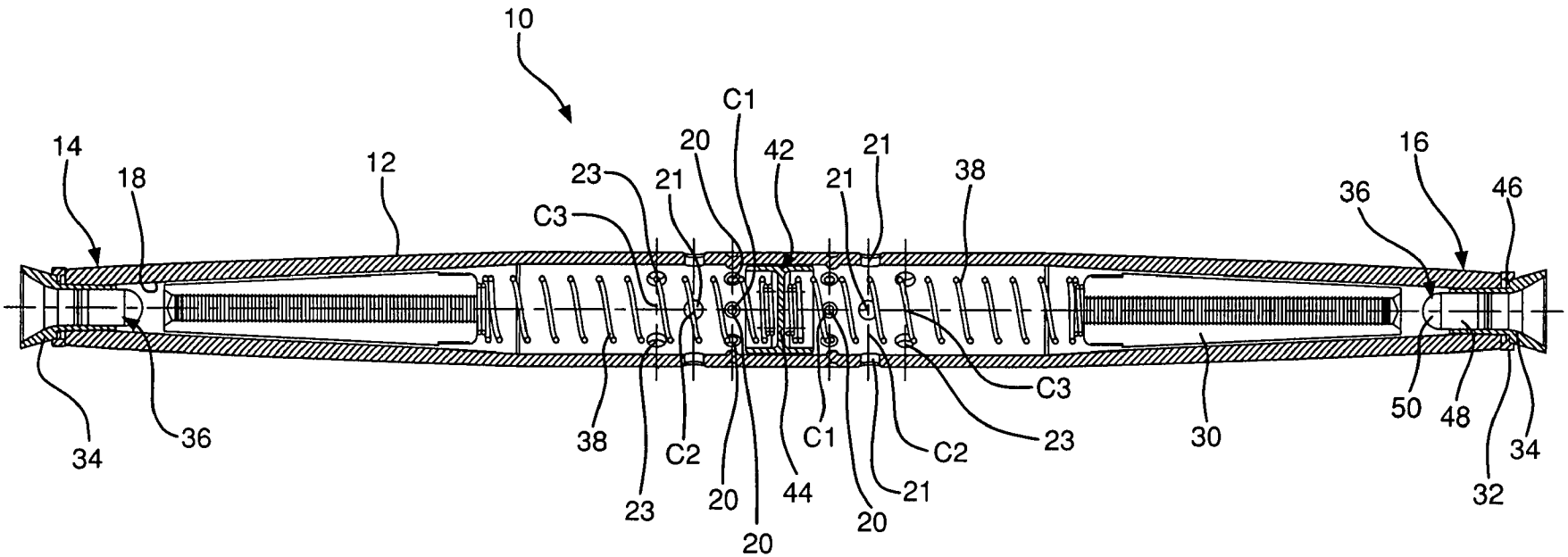
FIG. 2 is a front elevational view in section of the splice seen in FIG. 1.

Turning to FIGS. 1 and 2, a corrosion resistant splice 10 is shown including a housing 12 with a first end 14 and a second end 16, an interior cavity 18 therebetween, a plurality of drainage openings 20, and clamps or jaws 30 at the first and second ends 14, 16 for retaining the cables 40.

The housing 12 is a tubular body extending along a longitudinal axis with the first end 14 disposed opposite the second end 16. Both ends are conical and taper away from the center 24 of the splice 10. The center section 24 of the splice 10 is defined by the plurality of drainage openings 20 placed in polar array about the major diameter 22 of the splice body 10. This orientation of the openings 20 concentrated towards the middle of the splice 10 allows for rainwater transporting a majority of contaminants and corrosive elements to exit the splice 10 such that the flushing of rainwater rinses the splice 10.

By designing the splice 10 in this manner, contaminants flowing from one end 14 or 16 of the splice 10 are purged from the interior cavity 18 via the openings 20 before the contaminated water can be transported towards the opposite end 16 or 14 of the splice 10. Also, the thickness of the splice wall must be large enough to allow the inclusion of the drainage openings 20 such that the mechanical integrity of the splice 10 required to withstand the maximum tensile load of the conductor is not diminished. Similarly, the arrangement of the openings 20 is carefully selected to balance the tensile strength threshold of the splice 10.

By arranging the openings 20 in a non-radial pattern or polar array, the cross-sectional area and tension strength of the splice 10 are maintained without crippling the structure of the splice 10. Openings in polar array are oriented in mirror image and evenly spaced about a center diameter 22 of the splice 10. Openings 20 are evenly distributed about a first circumference C1 a first distance A from the center diameter 22 of the splice 10. The center 22 is defined by a plane equally spaced between the first and second ends 14, 16 and extending perpendicularly to the longitudinal axis. It is estimated that each of the centers of the six openings 20*a*, 20*b*, 20*c*, 20*d*, 20*e*, 20*f* are located at approximately 60° arcs evenly distributed about the first circumference C1 of the splice 10.

The second set of openings 21 is distributed about a second circumference C2 a second distance B from the center of the splice 10. Each of the centers of each of the four openings 21*a*, 21*b*, 21*c*, 21*d* are not evenly spaced about the circumference C2. Rather, a first pair of the openings is 120° apart along the circumference C2 and a second pair of the openings is 120° apart along the circumference C2 such that the two pairs are 60° apart. The third set of openings 23 is distributed about a third circumference C3 a third distance C from the center of the splice 10. Moreover, each of the centers of the four openings 23*a*, 23*b* is distributed about the circumference of the splice 10 90° apart. This configuration results in the centers of two of the first openings 20*a*, 20*c*, 20*e*, 20*f* being axially aligned with the centers of the second openings 21*a*, 21*b*, 21*c*, 21*d*. Further, the third openings 23 are axially aligned with one diametrically opposed pair of the first openings 20*b* and 20*d*. The specific locations and number of drainage holes may be modified.

A mirror image of the arrangement is configured on the opposite side of the diameter 22. The foregoing arrangement allows maintenance of sufficient cross-section between openings 20, 21, and 23. The openings 20, 21, and 23 are sized and arranged so as to not compromise the strength of the splice 10. The openings closest to the center diameter 22 of the splice 10 are generally smaller than the openings furthest from the center. As seen in FIG. 1, the first openings are smaller than the second and third openings 21, 23.

The cross section of the splice 10 should be sufficient for withstanding the increase in hoop stress resulting from the additional lubricity of a synthetic grease inhibitor during the advancement of the jaws affected by the conductor tension and for dispersing electrical current through a larger mass, thereby mitigating the thermal shock effect of occasional fault currents to which conventional splices are inadvertently subjected throughout their service life. The splice housing 12 is required to withstand the maximum breaking strength of the largest conductor for which it is designed. In a preferred embodiment, the particular size is designed for a conductor rated for 3,535 lbs and has a safety factor of only 1.4.

Figure 4:
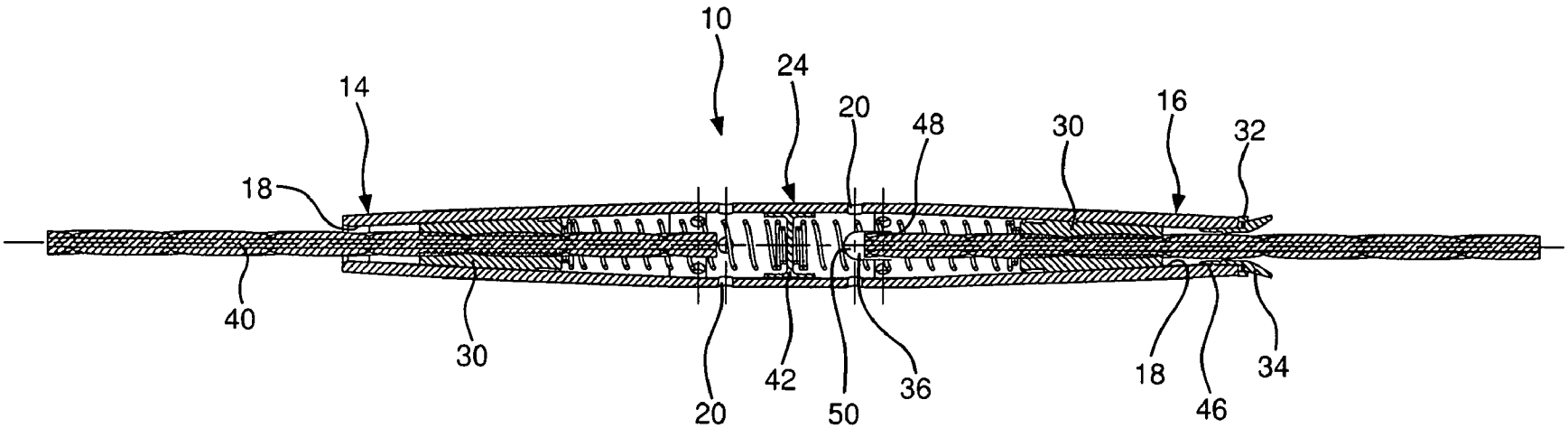
FIG. 4 is an elevational view in section of the splice seen in FIG. 3 along the line E-E.

The conical ends 14, 16 are located on opposite sides of the splice 10 and include a pair of jaws 30 disposed in each end. As seen in FIG. 4, the jaws 30 are designed to retain the six-stranded cables 40 such that when a force is applied to redact the cables 40, the force of the jaws 30 increases as applied against the cables 40. Since both ends of the splice 10 are identical, one end will be discussed and it will be understood that the description applies to both ends.

Figure 3:
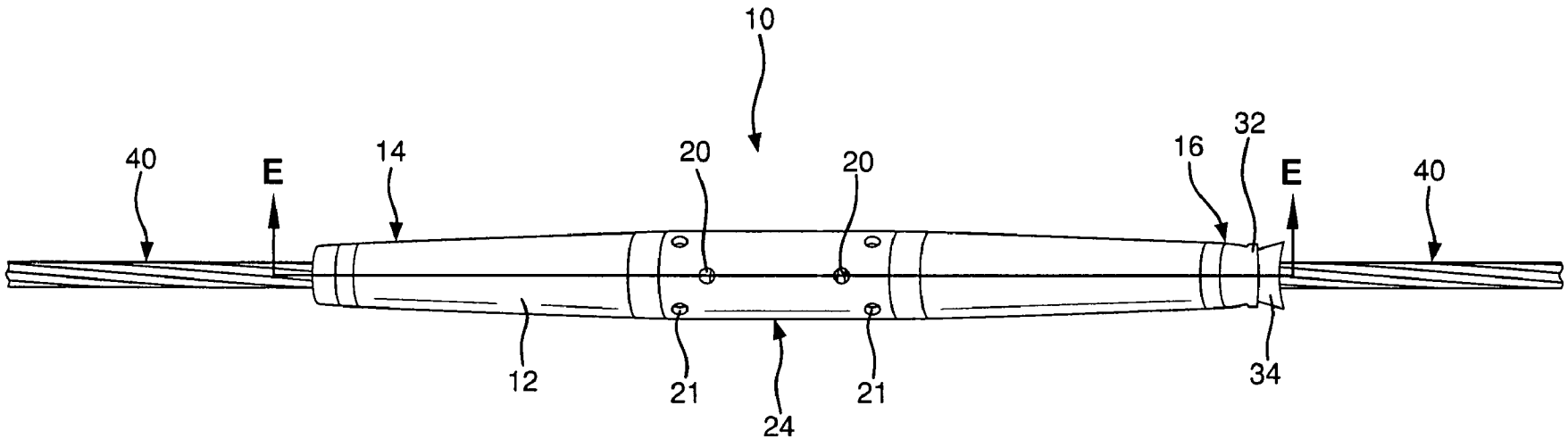
FIG. 3 is a front elevational view of the splice seen in FIGS. 1 and 2 with cables inserted at the first and second ends.

Turning to FIGS. 3 and 4, the furthest or outer edge of the conical end 16 includes a marking ring 32. The marking ring 32 serves as an indicator such that a user knows which of the ends receives a specific cable. The marking ring 32 is typically color coded to indicate which size cable can be accommodated in the conical end 16. A tapered funnel guide 34 extends from the interior 18 of the splice 10 to receive the cable 40.

The funnel guide 34 is a device for initially receiving an end cable 40. Its shape prevents the cable strands 40 from splaying outwardly in the direction with which the cable strands 40 naturally tend to expand. The funnel guide 34 is open-ended and oriented such that the narrowest region 46 of the funnel 34 is exposed to the interior cavity 18 of the splice 10.

Once the cable 40 penetrates the funnel guide 34, the cable 40 is received within the pilot cup 36 and retracts towards the center section 24 of the splice 10. The pilot cup 36 is a substantially hemispherically shaped or nosed cylinder made out of stainless steel and having an open end 48 and a closed end 50. In its initial position before receiving cable 40, the pilot cup 36 rests against the funnel guide 34 such that the open end 48 is adjacent the narrowest region 46 of the funnel guide 34.

Once the cable 40 and pilot cup 36 are engaged, the pilot cup 36 nests against the end of the cable 40 such that the open end 48 surrounds the cable 48 and keeps the individual strands of the cable 40 from separating. Approximately eight to ten pounds of force are required to push the cable 40 into the pilot cup 36 and advance the closed end 50 towards the center of the splice 10, transporting the cable 40 towards a center of the housing 12. Once the retractable pilot cup 36 passes the jaws 30, the springs 38 and the center partition or stopper 32 are the primary structures preventing the jaws 30 from advancing forward towards the conical ends 14, 16.

Turning to FIG. 4, the jaws 30 are half frustoconical shaped to approximate the conical section of the housing 12 such that when urged toward the outer tapered ends 14, 16 by the springs 38, the jaws move toward one another and increase the force applied on the cable 40, thus increasing clamping forces on the cable 40. The jaws 30 are disposed towards the conical ends 14, 16 of the splice 10 and adjacent the retractable pilot cup 34. The springs 38 bias the jaws 30 nested towards the ends of the splice 10. Also, the jaws 30 are equipped with an inner cable gripping surface with grip enhancing features such as a series of teeth, or other surface texture, which bite into the opposed surface of the cable or conductor.

The springs 38 are made from activated stainless steel to counteract the formation of corrosive contaminants on the springs. Activated stainless steel is of approximately the same galvanic potential as aluminum, but it does not initiate a galvanic corrosion effect within the splice. The springs 38 compress and retract from the pressure placed upon them by the cups 36. Each set of jaws 30 has a biasing member or spring 38 adjacent their innermost end and opposite the tapered conical ends 14, 16.

The splice 10 further includes a barrier or center stopper 42 located along the major diameter 22 and disposed between each of the springs 38. As seen in FIG. 4, the stopper 42 serves as a seat against which the compression springs 38 are attached. The stopper 42 is circularly-shaped and supported by the interior walls of the splice 10, and is further strengthened by its own radial support 44 extending across the maximum diameter 22 of the splice 10. The radial support 44 is coupled to each of the springs 38.

Stopper 42 prevents the springs 38 and cups 36 from traveling any further distance across the interior of the splice 10 than that distance necessary to engage the cables 40. The stopper 42 transmits force from the innermost ends of the springs 38 towards the outermost ends of the springs 38. In this manner, the springs 38 are catapulted from the stopper 32 so movement is projected in one direction, from the stopper 42 towards the jaws 30 as the jaws 30 clamp the cables 40.

The splice 10 includes two variations of a corrosion inhibitor to compound the presence of contaminants in the interior cavity 18. The first inhibitor is applied to the interface between the jaws 30 and the conductor. The first inhibitor is a high temperature rated compound, comprising of a synthetic base grease carrier, enhanced with both thermally conductive and electrically conductive particulate.

A second corrosion inhibitor is a similar compound (using the same synthetic base grease, but without the particulate matter) used in the interface between the conical sections 14, 16 and the outer periphery of the jaws 30. The second inhibitor must provide a low friction engagement between the jaws 30 and housing 12 to allow the jaws 30 to advance toward the smaller end of the conical sections 14, 16, unrestricted by the particulate matter which would reduce lubricity of this interface.

While a particular embodiment has been chosen to illustrate the invention, it will be understood by those skilled in the art that various changes and modifications can be made therein without departing from the scope of the invention as defined in the appended claims.

What is claimed is:

1. A corrosion resistant splice, comprising:

a housing extending along a longitudinal axis and having a first end, an opposing second end, a center plane equally spaced between said ends and extending perpendicular to said longitudinal axis, and an interior cavity;

a plurality of drainage openings extending between an exterior surface of said housing and said interior cavity, said plurality of drainage openings including a first pair of openings located a first distance from said center plane along said longitudinal axis and a second pair of openings located a second distance from said center plane along said longitudinal axis, said second distance being larger than said first distance;

a first biasing member adjacent said first end and a second biasing member adjacent said second end; and a clamp located at each of said first and second ends for receiving a cable.

2. A corrosion resistant splice according to claim 1 wherein each of said biasing members is a spring attached to a center barrier.

3. A corrosion resistant splice according to claim 1, further comprising a stopper located along said interior cavity between each of said biasing members.

4. A corrosion resistant splice according to claim 1 wherein each of said drainage openings is oriented in polar array about a major diameter of said housing.

5. A corrosion resistant splice according to claim 1 wherein said first and second ends are tapered.

6. A corrosion resistant splice according to claim 1 wherein said first and second ends encompass a funnel guide adapted to receive an end of said cable.

7. A corrosion resistant splice according to claim 6 wherein said funnel guide has a narrowest region exposed to said interior cavity.

8. A corrosion resistant splice according to claim 1 wherein each of said clamps is adjacent a retractable pilot cup for transporting said cable towards a center of said housing.

9. A corrosion resistant splice according to claim 8 wherein said retractable pilot cup is made out of stainless steel.

10. A corrosion resistant splice according to claim 8 wherein said retractable pilot cup is substantially hemi-spherically shaped with an open end and a closed end.

11. A corrosion resistant splice according to claim 1 wherein each of said clamps is semi frustoconical.

12. A corrosion resistant splice according to claim 1 wherein said first and second ends encompass a funnel guide to receive an end of said cable.

13. A corrosion resistant splice according to claim 12 wherein said funnel guide has a narrowest region exposed to said interior cavity.

14. A corrosion resistant splice, comprising:

a housing extending along a longitudinal axis and having first and second tapered ends, a center plane equally spaced between said ends and extending perpendicular to said longitudinal axis, and an interior cavity;

a plurality of drainage openings extending between an exterior surface of said housing and said interior cavity and oriented in polar array about a major diameter of said housing, said plurality of drainage openings including a first pair of openings located a first distance from said center plane along said longitudinal axis and a second pair of openings located a second distance from said center plane along said longitudinal axis, said second distance being larger than said first distance;

a first spring adjacent said first end and a second spring adjacent said second end and separated by a stopper;

a clamp located at each of said first and second ends for receiving a cable; and a retractable pilot cup adjacent each of said clamps adapted for transporting said cable towards a center of said housing.

15. A corrosion resistant splice according to claim 14 wherein said retractable pilot cup is made out of stainless steel.

16. A corrosion resistant splice according to claim 14 wherein said retractable pilot cup is substantially hemi-spherically shaped with an open end and a closed end.

17. A corrosion resistant splice according to claim 14 wherein each of said clamps is semi frustoconical.

18. A method of splicing cables comprising the steps of:

feeding an end of a first cable through first end of a housing and into an interior cavity of the housing, the housing tapering toward the ends thereof and extending along a longitudinal axis;

feeding an end of a second cable through an opposite second end of said housing into the interior cavity, the housing tapering toward the second end thereof;

gripping the first and second cables by first and second pairs of frustoconical clamping jaws on the interior cavity adjacent the first and second ends thereof; and passing environmental moisture through a plurality of drainage openings into and out of the housing between the pair of clamping jaws to clean out corrosive agents, said plurality including a first pair of openings located a first distance from a center plane along the longitudinal axis and a second pair of openings located a second distance from the center plane along the longitudinal axis, the second distance being larger than the first distance, the center plane being equally spaced between the first and second ends and extending perpendicularly to the longitudinal axis.

* * * * *